United States Patent [19]
Olinsky
[11] 4,229,115
[45] Oct. 21, 1980

[54] NIB FOR A WRITING INSTRUMENT

[75] Inventor: Lester H. Olinsky, Nazareth, Pa.
[73] Assignee: Binney & Smith, Inc., Easton, Pa.

[21] Appl. No.: 11,147
[22] Filed: Feb. 12, 1979
[51] Int. Cl.[3] ..... A43K 5/00
[52] U.S. Cl. ..... 401/196; 401/198
[58] Field of Search ..... 401/196, 198, 199, 49, 401/292, 265, DIG. 3

[56] References Cited

U.S. PATENT DOCUMENTS

| | | | |
|---|---|---|---|
| 371,133 | 10/1887 | Fisher | 401/DIG. 3 |
| 2,396,058 | 3/1946 | Rath | 401/198 |
| 3,586,454 | 6/1971 | Funahashi | 401/198 |
| 3,969,027 | 7/1976 | Randar et al. | 401/199 |
| 4,076,427 | 2/1978 | Anderson | 401/198 |

OTHER PUBLICATIONS

Robert Hain Associates, Inc., Drawing Nib, Jan. 20, 1977.

*Primary Examiner*—John D. Yasko
*Attorney, Agent, or Firm*—Charles A. Blank

[57] ABSTRACT

A marker nib having a tapered tip portion, a substantially cylindrical barrel portion, and a trunk having a frusto-conical portion of smaller maximum diameter than the barrel portion and extending therefrom. The nib can be manufactured in a mold requiring simple tooling and having a parting line for the mold segments at the junction of the barrel portion with the trunk.

3 Claims, 2 Drawing Figures

NIB FOR A WRITING INSTRUMENT

Figure 1:
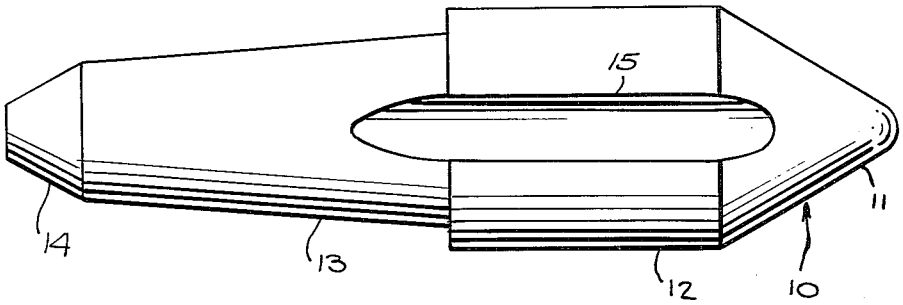

This invention relates to a nib for a writing instrument, and, more particularly, to a marker pen nib.

One marker pen nib previously proposed has a tip portion, a substantially cylindrical barrel portion, a short conical neck of the same maximum diameter as the barrel portion extending from the barrel portion to an elongated cylindrical trunk for extending into the ink reservoir of the pen. This prior nib had the disadvantage that it required a manufacturing mold needing more complex tooling than is desirable or a manufacturing mold in which the parting line of segments of the mold occurred near the center of the barrel portion. Occasional mismatch of the mold segments would then result in a nib having a non-cylindrical barrel, which, when inserted in a nib holder or pen, would result in undesired scrapings of the nib. A nib in accordance with my invention can be manufactured in a mold requiring simple tooling and having a parting line for the mold segments at the junction of the barrel portion with a trunk portion of smaller diameter, thereby eliminating any lack of smoothness of the barrel due to mismatch of mold segments.

It is an object of the present invention, therefore, to provide a new and improved nib for a writing instrument.

It is another object of the invention to provide a new and improved marker nib which has a substantially cylindrical barrel portion.

In accordance with the invention, a molded nib for a writing instrument comprises a tapered tip portion of substantially circular cross section and a substantially cylindrical barrel portion extending from the tip portion and of the same diameter as the maximum diameter of the tip portion. The nib includes a trunk comprising a frusto-conical porition of smaller maximum diameter than the barrel portion and extending from the barrel portion.

For a better understanding of the present invention, together with other and further objects thereof, reference is made to the following description, taken in connection with the accompanying drawings and its scope will be pointed out in the appended claims.

Figure 2:
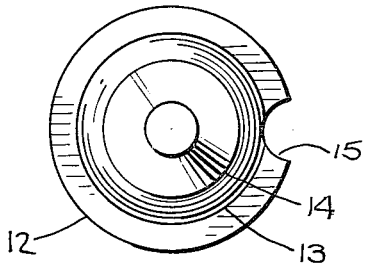

Referring now to the drawings:

FIG. 1 is a plan view of a nib constructed in accordance with the invention; and FIG. 2 is an end view of the FIG. 1 nib.

Referring now more particularly to FIGS. 1 and 2 of the drawings, a molded nib 10 for a writing instrument such as a marker pen comprises a tapered tip portion 11 of substantially circular cross section and a substantially cylindrical barrel portion 12 extending from the tip portion 11 and of the same diameter as the maximum diameter of the tip portion. The nib comprises a trunk comprising a frusto-conical portion 13 of smaller maximum diameter than the barrel portion 12 and extending from the barrel portion 12. The trunk has a second shorter frusto-conical portion 14 extending from the elongated frusto-conical portion 13 and forming the end of the nib. The nib also has an elongated slot 15 extending from the frusto-conical portion 13 across the barrel portion 12 and into the tip portion 10.

The nib may be made from a suitable porous plastic material, preferably polyethylene or vinyl. The trunk 13, 14 extends into the ink reservoir of a suitable holder or marker pen (not shown). The pen extends over the trunk 13, 14 and over the barrel portion 12 almost to the junction of the barrel portion 12 and the tapered tip portion 10. The pen grips the barrel portion 12 tightly and it is important that the barrel portion 12 be substantially cylindrical so that when the nib is inserted in the pen, the barrel portion 12 does not scrape on the pen, damaging the nib and leaving scrapings on the nib which require the nib to be cleaned of the scrapings.

To provide a substantially cylindrical barrel portion, the nib may be molded in a two-segment mold requiring only simple tooling and because of the shape of the nib with the barrel portion 12 of larger diameter than the trunk 13, the parting line of the mold segments can be located at the junction of the trunk 13 and the barrel portion 12, thereby eliminating any possible deformation of the barrel portion 12 which might occur due to slight mis-match of the mold segments if the parting line of the mold segments were positioned along the barrel portion 12 or if the trunk were of the same maximum diameter as the barrel portion and the parting line of the mold segments were positioned at the junction of the barrel portion and the trunk.

The end of the barrel portion 12 around the trunk 13 may also be used as a stop when inserting the nib in the marker holder by abutting an internal member of the marker holder.

The frusto-conical portion 14 is shaped to aid in filling the mold from the end of the trunk. The slot 15 acts as a suitable air vent to the interior of the marker holder.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

I claim:

1. A molded nib for a writing instrument comprising:
   - a porous plastic tapered tip portion of substantially circular cross section;
   - a porous plastic substantially cylindrical barrel portion extending from said tip portion and of the same diameter as the maximum diameter of said tip portion; and
   - a porous plastic trunk comprising a frusto-conical portion of smaller maximum diameter than said barrel portion and extending from said barrel portion.

2. A nib in accordance with claim 1 in which said trunk comprises an elongated frusto-conical portion of smaller maximum diameter than said barrel portion and extending from said barrel portion and a second shorter frusto-conical portion extending from said elongated frusto-conical portion and forming the end of the nib.

3. A nib in accordance with claim 1 having an elongated slot extending from said frusto-conical portion across said barrel portion and into said tip portion.

* * * * *